United States Patent [19]

Singer et al.

[11] Patent Number: 4,904,374

[45] Date of Patent: Feb. 27, 1990

[54] FROTH FLOTATION

[75] Inventors: Haimi N. Singer, Johannesburg; Amor Jordaan, Sasolburg, both of South Africa

[73] Assignee: Sentrachem Limited, Transvaal, South Africa

[21] Appl. No.: 253,032

[22] Filed: Oct. 4, 1988

[30] Foreign Application Priority Data

Oct. 8, 1987 [ZA] South Africa ..... 87/7568

[51] Int. Cl.[4] ..... B03D 1/02; B03D 1/06

[52] U.S. Cl. ..... 209/166; 252/61

[58] Field of Search ..... 209/166, 167; 252/61; 423/138, 26

[56] References Cited

U.S. PATENT DOCUMENTS

| | | | |
|---|---|---|---|
| 1,955,978 | 4/1934 | Ruth | 209/167 |
| 2,007,176 | 7/1935 | Brinker | 209/166 |
| 2,342,277 | 2/1944 | Herkenhoff | 209/167 |
| 3,925,218 | 12/1975 | Zipperian | 209/166 |
| 4,684,459 | 8/1987 | Klimpel | 209/166 |
| 4,702,822 | 10/1987 | Klimpel | 209/166 |

FOREIGN PATENT DOCUMENTS

| | | | |
|---|---|---|---|
| 11248 | of 1913 | Australia | 209/167 |
| 853248 | 10/1970 | Canada | 209/167 |

*Primary Examiner*—David L. Lacey
*Assistant Examiner*—Thomas M. Lithgow
*Attorney, Agent, or Firm*—Birch, Stewart, Kolasch & Birch

[57] ABSTRACT

A method of selectively recovering an arsenopyrite, pyrrhotite or like mineral from a material containing such a mineral and pyrite which includes the steps of providing a slurry of the material, adding a dialkyl ($C_{3-8}$)-dithiophosphate to the slurry, passing a gas through the slurry to cause the mineral to be carried to the surface of the slurry and report in a first float concentrate, removing this concentrate from the slurry, activating the mineral remaining in the slurry by adding a suitable water-soluble copper salt to the slurry, adding a monoalkyl ($C_{3-10}$)-dithiocarbamate to the slurry, passing a gas through the slurry to cause mineral to be carried to the surface of the slurry and form a second float concentrate, removing the second concentrate from the slurry and combining the first and the second float concentrates.

11 Claims, 2 Drawing Sheets

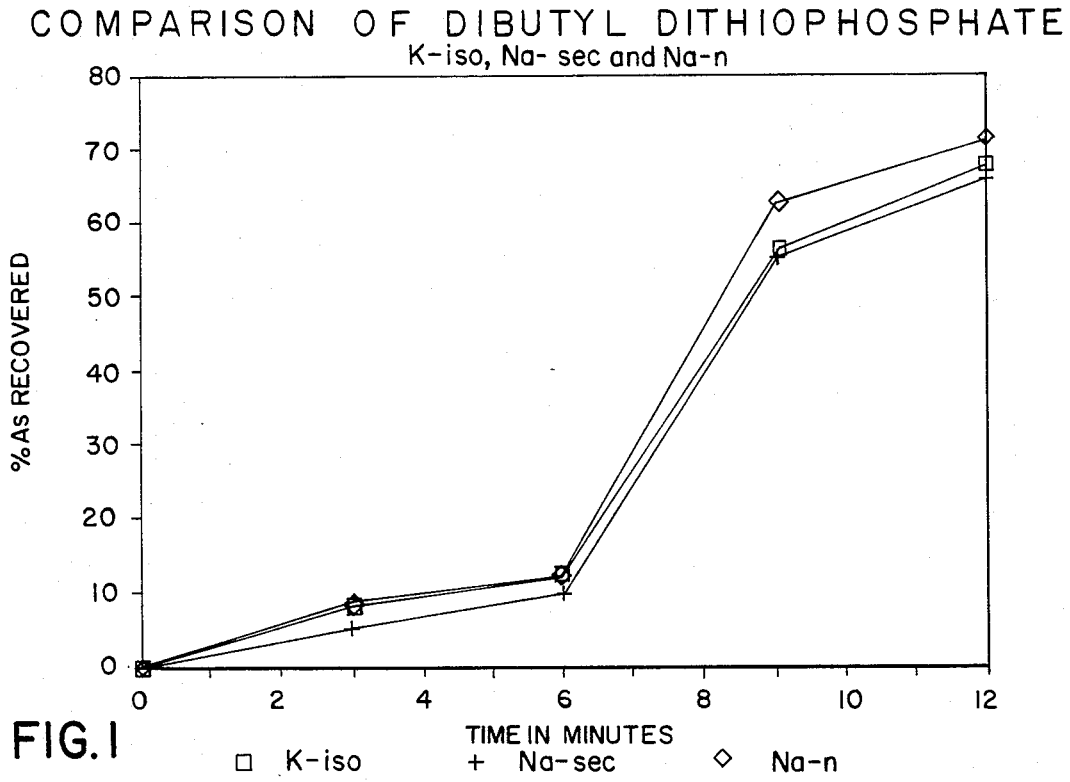
FIG.1
FIG.2
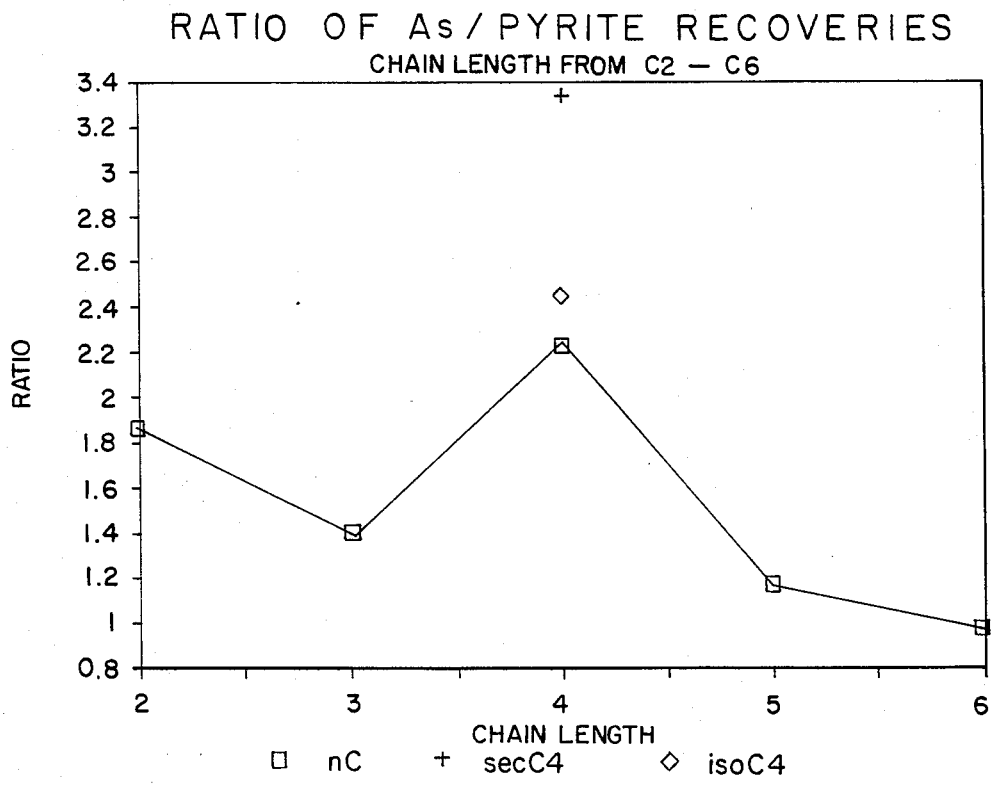

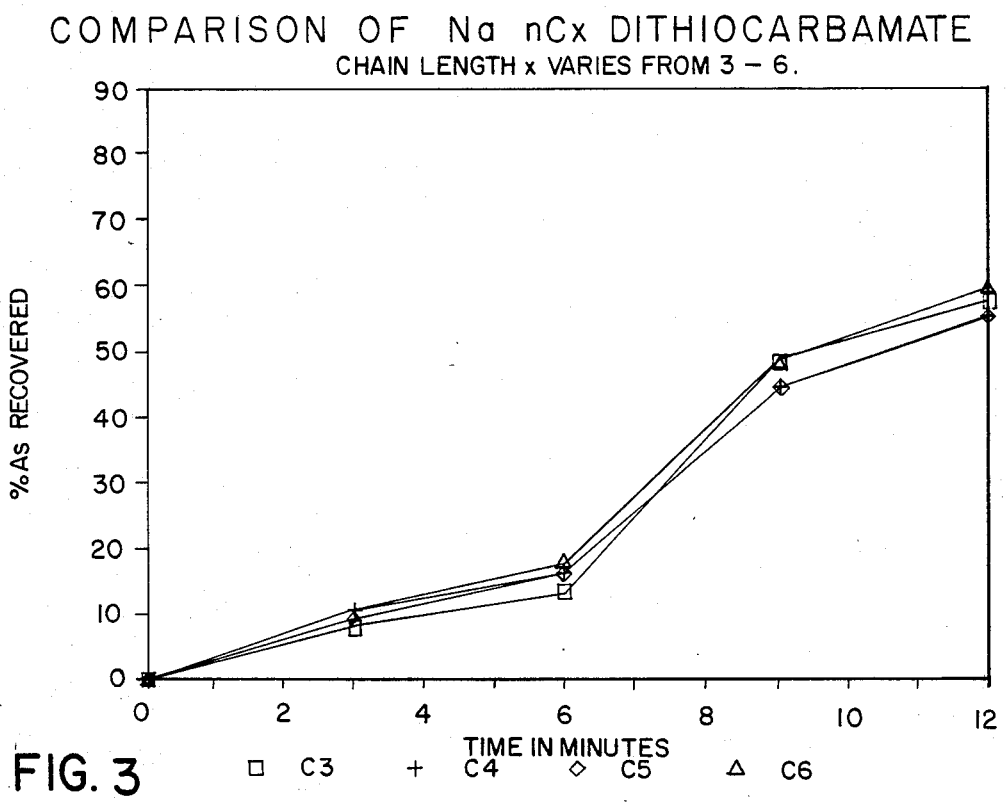
FIG. 3
FIG. 4
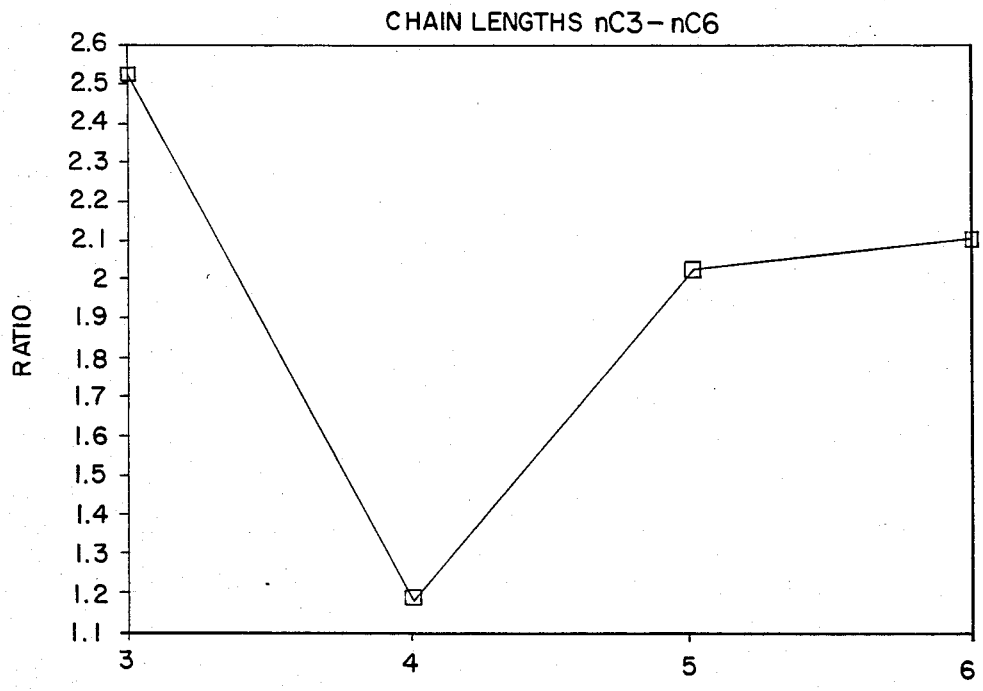

FROTH FLOTATION

BACKGROUND OF THE INVENTION

This invention relates to froth flotation.

Froth flotation is one of the most important processes currently used to extract the desired mineral from the accompanying unwanted gangue minerals in a pulp. Froth flotation is a means of treating a pulp of finely ground ores so that it yields the valuable or desired mineral in a concentrate that will be amenable to further processing. The process involves the imparting of a water-repellant character to the wanted mineral particles by chemicals that are called collectors or promotors. Under favourable conditions, these chemically coated particles become attached to the air that is bubbled through a pulp and will thus float on the surface.

The surface tension of the pulp is reduced by a second chemical called a frother, thereby producing a stabilised froth containing the wanted mineral particles on the surface of the pulp. This froth is skimmed off yielding a concentrate in which the desired mineral is present in much higher percentage than in the original ore.

Froth flotation is also used to separate one component of a mineral mixture from another component of that mineral mixture.

There are a number of sulphide minerals which contain gold. Examples of these minerals are arsenopyrite, pyrrhotite and pyrite. In arsenopyrite and pyrrhotite, the gold is in occluded form which makes it difficult to be reached by conventional leaching methods. On the other hand, the gold in pyrite is generally present in a condition in which it is readily amenable to leaching by conventional methods. These various sulphide minerals generally exist together. The fact that the gold exists in the various components of the mixture in a different form, complicates the recovery of the gold from such mixtures. It is thus desirable to separate arsenopyrite and pyrrhotite from pyrite.

SUMMARY OF THE INVENTION

According to the present invention, there is provided a method of selectively recovering an arsenopyrite, pyrrhotite or like mineral from a material containing such mineral and pyrite including the steps of providing a slurry of the material, adding a collector to the slurry, passing a gas through the slurry causing the mineral to be carried to the surface of the slurry and report in a float concentrate, and removing the concentrate from the slurry, characterised in that the collector comprises, in combination, a dialkyl-dithiophosphate of formula (I) and a monoalkyl-dithiocarbamate of formula (II):

Dialkyl-dithiophosphate of formula (I)

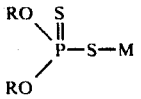

(I)

wherein

R = alkyl of 3 to 8 carbon atoms; and

M = alkali metal or ammonium

Monoalkyl-dithiocarbamate of formula (II)

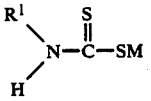

(II)

wherein

R′ = alkyl of 3 to 10 carbon atoms, and

M = alkali metal or ammonium.

BRIEF DESCRIPTION OF THE DRAWINGS

FIGS. 1 to 4 are various graphs illustrating advantages to be obtained by use of various dithiophosphates and dithiocarbamates in the practice of the invention.

DETAILED DESCRIPTION OF THE INVENTION

The invention involves floating arsenopyrite, pyrrhotite or like mineral selectively from pyrite and is characterised by the use of a dialkyl-dithiophosphate and monoalkyl-dithiocarbamate which are used in combination as the collector. This combination may be employed in various ways. The dialkyl-dithiophosphate and monoalkyl-dithiocarbamate may be added to the slurry as a mixture.

Alternatively, and preferably, the dialkyl-dithiophosphate is first added to the slurry and this is followed by addition to the slurry of the monoalkyl-dithiocarbamate. Preferably, the dialkyl-dithiophosphate is first added to the slurry, gas is passed through the slurry to cause the mineral to be carried to the surface of the slurry and report in a first float concentrate, the mineral remaining in the slurry is activated, the monoalkyl-dithiocarbamate is added to the slurry and a gas passed through the slurry to cause the mineral to be carried to the surface of the slurry and report in the second float concentrate. The first and second float concentrates will generally be combined. Using this particular manner of carrying out the invention, it has been found that the selectivity is such that at least 60% of the arsenopyrite present in the material which also contains pyrite reports in the combined float concentrate while only about 15 to 20% of the pyrite reports in the concentrate.

Activation of the mineral takes place after the first float has been completed. This, it has been found, is important for otherwise the selectivity of the arsenopyrite or like mineral flotation from the pyrite is adversely affected. Activation may take place by addition to the slurry of a water-soluble copper salt such as copper sulphate. It is believed that activation of the mineral occurs by coating thereof with the copper and so sufficient copper salt should be added to achieve this. The amount of copper salt will vary according to the amount of arsenopyrite, pyrrhotite or like mineral present in the material. The alkyl groups of the dithiophosphate preferably has 3 to 6 carbon atoms. The preferred dithiophosphate is a dibutyl-dithiophosphate, more preferably di-sec-butyl-dithiophosphate. The dithiophosphate salt is preferably a sodium or potassium salt.

The alkyl of the monoalkyl-dithiocarbamate preferably has 3 to 6 carbon atoms. The preferred monoalkyl-dithiocarbamate is a mono-propyl-dithiocarbamate, more preferably mono-n-propyl-dithiocarbamate. Another particularly useful monoalkyl-dithiocarbamate has been found to be a mono-$C_6$-alkyl-dithiocarbamate, preferably a mixture of mono-n-hexyl-dithiocarbamate and mono-cyclohexyl-dithiocarbamate. The carbamate salt is preferably a sodium or potassium salt.

As is known in the art, the surface tension of the slurry or pulp may be reduced by means of a suitable frother which is added to it. Suitable frothers which may be added are known in the art and include MIBC, polypropylene glycol, $C_5$–$C_6$ alcohols and triethoxybutane.

The flotation will typically take place at a temperature in the range of 5° to 30° C.

The pulp density of the slurry will typically be in the range 1,15 to 1,35.

The flotation is preferably carried out at a pH in the range 7 to 12.

The liquid medium for the slurry will be water and the gas will generally be air.

The use of a combination of dialkyl-dithiophosphate and monoalkyl-dithiocarbamate as a collector results in the excellent selective flotation of arsenopyrite and pyrrhotite from pyrite in a mixture of the minerals. When such minerals contain gold, each fraciton can then be subjected to its own leaching conditions designed to optimise the gold recovery from that fraction.

The invention will now be illustrated by the following examples.

EXAMPLE 1

A mixture of gold-bearing arsenopyrite, pyrrhotite and pyrite from a gold mine in the Barberton district was ground in a ball mill to 28% plus 75 microns. Lime was added to the mill prior to grinding. The ground mixture had water added to it to produce a slurry which was introduced into a flotation cell. 80 g/t of copper sulphate was added to the slurry and allowed to activate the slurry over a period of 6 to 10 minutes.

A collector as hereinafter defined was then added to the slurry and air was blown through the thus treated slurry. A froth concentrate formed on the surface of the slurry and was collected.

The process was carried out using a number of different collectors as described below:

1. Senkol 258—a mixture of monohexyl-dithiocarbamate and monocyclohexyl-dithiocarbamate in a ratio of 40:60 on a weight basis—sodium salts in both cases.

2. A mixture of the collector (1) and sodium diisobutyl-dithiophosphate.

In each case the arsenopyrite and pyrrhotite reported in the froth concentrate, while the pyrite remained in the slurry. The results obtained are set out in Table 1.

TABLE 1

| Process pH | Reagent | % arsenopyrite & pyrrhotite in concentrate |
|---|---|---|
| 10,6 | 1 | 19,30 |
| 10,6 | 1 | 27,81 |
| 10,6 | 1 | 20,56 |
| 10,6 | 1 | 11,73 |
| 8,6 | 1 | 11,98 |
| 8,6 | 1 | 32,08 |
| 9 | 1 | 12,50 |
| 9 | 1 | 12,02 |
| 10,1 | 1 | 21,17 |
| 10,1 | 1 | 17,97 |
| 10,9 | 2 | 56,63 |
| 10,9 | 2 | 74,03 |
| 11,25 | 2 | 53,36 |
| 11,25 | 2 | 51,41 |

It will be noted from the above results that a collector consisting of a mixture of the carbamates and the phosphate produced particularly good results.

EXAMPLE 2

A coarse ore containing a mixture of arsenopyrite and pyrite was milled to a size such that about 70% was −75 microns. The milled ore was transferred to a laboratory cell and the pulp density adjusted by addition of water to 1,25. The pH was adjusted to 8,5.

30 grams per ton of sodium di-sec-butyl-dithiophosphate was added to the slurry and thereafter a frother, MIBC, was added in an amount of 30 grams per ton. The slurry was conditioned for 3 minutes and then air was bubbled through the slurry. The froth which was produced floated to the surface and collected as a froth concentrate. This concentrate was removed from the slurry over 2 to 3 minutes.

Copper sulphate was added to the slurry in an amount of 160 grams per ton. The slurry was conditioned for a period of 6 minutes. MIBC was thereafter added in an amount of 20 grams per ton. Senkol 258 was added to the slurry in an amount of 120 grams per ton. The slurry was conditioned for 3 minutes and air then passed through it. The air created a froth which floated to the surface where it collected as a froth concentrate. The froth concentrate was removed from the slurry and combined with the first concentrate.

Analysis showed that in excess of 70% of the arsenopyrite which was present in the original ore reported in the combined froth concentrate while only 15 to 20% of the pyrite present in the original ore reported in this concentrate.

EXAMPLE 3

The procedure of Example 2 was followed, save that a variety of dialkyl-dithiophosphates were used in the first stage of the flotation. The dialkyl-dithiophosphates used were diethyl-dithiophosphate, di-n-propyl-dithiophosphate, dibutyl-dithiophosphate (normal, secondary and iso), di-n-pentyl-dithiophosphate and di-n-hexyl-dithiophosphate. The alkali metals for these salts were either sodium or potassium. The yields and selectivity of the dithiophosphates were compared and the results obtained are set out in FIGS. 1 and 2.

FIG. 1 illustrates graphically the percent arsenopyrite reporting in the concentrate over a period of 12 minutes with the three forms of dibutyl-dithiophosphate. After 6 minutes, the first float had been completed while the second float had been completed after 12 minutes. It will be noted that in all instances at least 60% of the arsenopyrite reported in the concentrate. There was no material difference between the various dithiophosphates used.

FIG. 2 illustrates graphically the ratio of arsenopyrite to pyrite in the concentrate. It will be noted that all three dibutyl-dithiophosphates were significantly better than the other dithiophosphates with di-sec-butyl-dithiophosphate proving to be the one which produced the highest ratio and hence selectivity.

EXAMPLE 4

The procedure set out in Example 2 was followed save that the dithiocarbamate was varied. The dithiocarbamates used were mono-n-propyl-dithiocarbamate, mono-n-butyl-dithiocarbamate, mono-n-pentyl-dithiocarbamate and Senkol 258. The yields and selectivity of each of the dithiocarbamates were compared and the results obtained are set out in FIGS. 3 and 4.

FIG. 3 illustrates the percentage arsenopyrite reporting in the concentrates during the two stages of the flotation. It will be noted that in all cases about 60% or more of the arsenopyrite reported in the final concentrate. There was no material difference between the various dithiocarbamates.

FIG. 4 illustrates the selectivity of the various dithiocarbamates, e.g. the higher the As/pyrite ratio the better. Mono-n-propyl-dithiocarbamate exhibited the best selectivity.

We claim:

1. A method of selectively recovering a mineral comprising at least one of arsenopyrite and pyrhotite, while selectively rejecting pyrite, from a material containing said mineral together with pyrite, said method comprising the steps of providing a slurry containing said material, said slurry having an upper surface, adding a water soluble copper salt as a promotor for said mineral and adding a collector for said mineral to the slurry, passing a gas through the slurry causing the mineral to be selectively carried to the surface of the slurry and report in a float concentrate while pyrite selectively remains in the resultant slurry, and recovering the mineral from the float concentrate, wherein the collector comprises, in a combination, a dialkyl-dithiophosphte of formula (I) and a monoalkyl-dithiocarbamate of formula (II) wherein the formulas for (I) and (II) are:

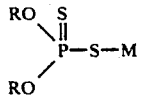

(I)

wherein

R=alkyl of 3 to 8 carbon atoms; and

M=alkali metal or ammonium

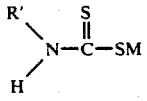

(II)

wherein

R'=alkyl of 3 to 10 carbon atoms, and M=alkali metal or ammonium.

2. The method according to claim 1 wherein the dialkyl-dithiophosphate and monoalkyl-dithiocarbamate are added as a mixture to the slurry.

3. The method according to claim 1 wherein the dialkyl-dithiophosphte is first added to the slurry followed by addition to the slurry of the monoalkyl-dithiocarbamate.

4. The method according to claim 1 wherein the dialkyl-dithiophosphate is a dibutyl-dithiophosphate.

5. The method according to claim 1 wherein the dialkyl-dithiophospate is di-sec-butyl-dithiophosphate.

6. The method according to claim 1 wherein the monoalkyl-dithiocarbamate is a mono-propyl-dithiocarbamate.

7. The method according to claim 1 wherein the monoalkyl-dithiocarbamate is mono-n-propyl-dithiocarbamate.

8. The method according to claim 1 wherein the monoalkyl-dithiocarbamate is a mono-$C_6$-alkyl dithiophosphate.

9. The method according to claim 8 wherein the monoalkyl-dithiocarbamate is mono-n-hexyl-dithiocarbamate and said mono-n-hexyl-dithiocarbamate is mixed with a mono-cyclohexyl-dithiocarbamate.

10. A method of recovering a mineral comprising at least one of arsenopyrite and pyrrhotite, while selectively rejecting pyrite, from a material containing said material together with pyrite, said method comprising the steps of providing a slurry containing said material, said slurry having an upper surface, adding as a collector for said mineral a dialkyl-dithiophosphate of formula (I)

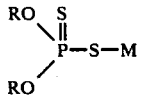

(I)

wherein

R=alkyl of 3 to 8 carbon atoms; and

M=alkali metal or ammonium to the slurry, passing a gas through the slurry causing the mineral to be selectively carried to the surface of said slurry and report in a first float concentrate while leaving a portion of said mineral and most of said pyrite in the resultant slurry, adding a water soluble copper salt to the resultant slurry to activate the remaining mineral and also adding as a collector for said mineral a monoalkyl-dithiocarbamate of formula (II)

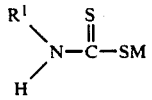

(II)

wherein

R'=alkyl of 3 to 10 carbon atoms, and

M=alkali metal or ammonium.

passing a gas through the slurry to cause the remaining mineral to be selectively carried to the resultant slurry surface and report in a second float concentrate while the pyrite remains in the second resultant slurry, and recovering the minerals from said first and second concentrates.

11. The method according to claim 10 wherein the water-soluble copper salt is copper sulphate.

* * * * *